US007632192B2

(12) United States Patent
Begert

(10) Patent No.: US 7,632,192 B2
(45) Date of Patent: Dec. 15, 2009

(54) MULTI-SPORT SWING TRAINING APPARATUS

(75) Inventor: David L. Begert, Santa Rosa, CA (US)

(73) Assignee: Axilon Sports, LLC, Santa Rosa, CA (US)

( * ) Notice: Subject to any disclaimer, the term of this patent is extended or adjusted under 35 U.S.C. 154(b) by 0 days.

(21) Appl. No.: 11/573,385

(22) PCT Filed: Aug. 12, 2005

(86) PCT No.: PCT/US2005/028719

§ 371 (c)(1),
(2), (4) Date: Feb. 7, 2007

(87) PCT Pub. No.: WO2006/020855

PCT Pub. Date: Feb. 23, 2006

(65) Prior Publication Data

US 2007/0232404 A1 Oct. 4, 2007

(51) Int. Cl.
*A63B 69/36* (2006.01)

(52) U.S. Cl. ..... 473/216; 473/215

(58) Field of Classification Search ..... 473/207, 473/212–216, 226, 227, 266, 277; 482/124
See application file for complete search history.

(56) References Cited

U.S. PATENT DOCUMENTS

| | | | | | |
|---|---|---|---|---|---|
| 2,103,502 | A | * | 12/1937 | Webster | 473/215 |
| 3,988,020 | A | * | 10/1976 | Carter | 482/55 |
| 4,662,640 | A | * | 5/1987 | Grander | 473/215 |
| 5,188,365 | A | * | 2/1993 | Picard | 473/213 |
| 5,190,512 | A | * | 3/1993 | Curran | 482/124 |
| 5,362,295 | A | * | 11/1994 | Nurge | 482/124 |
| 5,451,060 | A | * | 9/1995 | Dalbo | 473/215 |
| 5,704,856 | A | * | 1/1998 | Morse | 473/422 |
| 5,752,900 | A | * | 5/1998 | Holland, Jr. | 482/124 |
| 5,813,955 | A | * | 9/1998 | Gutkowski et al. | 482/124 |
| 6,095,936 | A | * | 8/2000 | Kirkpatrick et al. | 473/450 |

* cited by examiner

*Primary Examiner*—Nini Legesse
(74) *Attorney, Agent, or Firm*—Craig M. Stainbrook; Stainbrook & Stainbrook, LLP

(57) ABSTRACT

A multi-sport training apparatus for teaching and improving hitting and throwing skills, including an adjustable waist belt with a buckle; a resilient connector having a distal end and a proximal end, two clamps disposed on the waist belt such that when said waist belt is worn at least one clamp is located near the iliac crest of the user's leading hip and may be employed for adjustably capturing and retaining the proximal end of the resilient connector, a swivelable clip disposed on the distal end of said resilient connector, and a sports implement/hand connector having a hook for attachment to the clip. Also disclosed is a method of using the apparatus to teach hitting and throwing skills.

12 Claims, 10 Drawing Sheets

MULTI-SPORT SWING TRAINING APPARATUS

BACKGROUND OF THE INVENTION

1. Technical Field

The present invention relates generally to sports training devices, and more particularly to swing training apparatus, and still more particularly to a multi-sport swing training apparatus for use in teaching efficient and powerful striking and throwing motions in ballistic motion sports.

2. Background Art

Success in many sports requires the precise use of a powerful motion to propel a ball or object, either by throwing it or by using an implement (e.g., racquet, club or bat) to strike it. Though the sports can be quite diverse (e.g., golf, tennis, and baseball), there are significant similarities in the biomechanics and kinesiology of how power is generated and applied within the throwing and hitting skills characteristics of these sports.

There are several key principles of effective power generation in throwing and hitting motions. First, one must have a stable base, or platform, from which to generate power. Lower body balance, and control of the transfer of weight and momentum are vital for delivering force in the desired direction. Throwing and hitting motions are generally initiated by shifting the majority of our weight to the back foot and leg. This loads the large muscles of the leg—gastrocnemius in the calf, and quadriceps, hamstrings and adductors in the thigh—and the gluteals in the hip and pelvis.

The next anatomic level, viz., abdomen and trunk, contains several key muscle groups that help not only to stabilize the body's center of mass, but also to stretch and highlight the rotational differences between the lower and upper parts of the body. The abdominal, oblique and latisimus dorsi muscles must work together to maximize flexibility and enhance the body turn.

The benefit of coordinating lower body and trunk movements is that it maximizes axial rotation, or rotation around the spine. This translates into shoulder turn, which is the next principle for generating power. In fact, it is the differential rotation of the shoulders relative to generally stable hips and lower body that is one key to generating maximum stored (potential) energy before starting the forward swing.

The arms perform widely different functions depending on the sport, but there are three principles that pertain to generating power. First, in the preparation or windup phase of the motion, the arms must remain as tension-free as possible. Second, external rotation of the humerus at the shoulder is a key ingredient for matching the efforts of the body and arms (and therefore the implement). And, the position of function of the wrist must be maintained into the hitting or throwing zone. These three characteristics, to be detailed later, are essential to a number of hitting and throwing motions that are the foundation of many sports.

The initiation of the forward, or downswing, comes next, after the upper body is coiled upon the more stable lower body. Amateurs struggle mightily with this. If they haven't lost their ideal position on the backswing, most lose it immediately at the beginning of the downswing. Professionals seem to harness and deliver power with seemingly little effort. What's the difference?

Efficiently generating power in a forward swing or throw requires several things. First, weight must be partly transferred to the forward foot while maintaining balance and a stable platform. Second, rapid hip rotation commences, during and in conjunction with continued weight shift, effectively increasing the differential rotation between the shoulders and lower body. This produces "lag", i.e., a stretching of the muscles in the side and back between the upper torso and the hips, which is the key to preserving the potential energy of the backswing. Third, the arms, moving in unison with the body as it uncoils, are whipped through the throwing/hitting zone, thereby increasing club head/racquet/bat/ball speed. Fourth, by not trying to manipulate the hands or implement through contact, a full and unrestricted follow through can ensue to complete the motion.

Amateurs are often overloaded with swing thoughts and doubts, which go a long way towards producing tension in the arms and hands, and limiting power. In part this happens because most people have never felt the proper sequence that results in unloading and transferring stored power. Fundamentally, at some point in their swing motion most people have poorly sequenced body and arm movements (and therefore the implement), thus preventing them from maximizing their power. For example, in tennis it often happens early in the swing due to faulty footwork and occasionally bad advice ("Take the racquet back early!") which leads to an all arm motion. In baseball, the difficulty of adjusting to various pitches makes it hard to apply the stored power. In golf, many people rush at the top of the swing, turning the shoulders too early relative to the hips, and this results in casting the club, loss of power, and a sliced shot in most cases.

To date, no individual sport swing training apparatus has adequately addressed the key issues of power discussed above. And specifically, no swing training device on the market attempts to train for multiple sports by harnessing the proper sequence of muscle movements for generating and applying power. The multi-sport swing training apparatus of the present invention addresses these deficiencies.

Hundreds of devices have been invented to help people with their swings in sports. They are sport specific, and the vast majority are golf devices. None have been devised to correctly harness power, reinforce the proper sequence in applying it, and adapt to multiple sports.

DISCLOSURE OF INVENTION

The present invention is a swing training apparatus for use in a variety of sports that involve striking and throwing motions.

The multi-sport swing training apparatus of the present invention links and maintains the connection between the lower body and the arms. It includes a resilient connector that attaches to the forward hip—the left hip for right handed athletes—whose powerful rotation early in the downswing is instrumental in generating the proper sequence. The material of the resilient connector is preferably surgical tubing with precise elasticity. The other end of the trainer is a specially designed adaptable handle that attaches directly to the implement, for example, a bat, tennis racquet or golf club, or the wrist when the sports implement is a ball and the skill to be learned is throwing. These features result in the following objects and advantages:

It is therefore an object of the present invention to provide a multi-sport swing training apparatus that is light, portable, easy to put on and, most importantly, easy to use.

It is a further object of the present invention to provide a multi-sport swing training apparatus that links the lead hip and the implement so that the trainer ensures coordinated effort of the body and arms, which helps prevent the "disconnect" most people experience.

It is yet another object of the present invention to provide a multi-sport swing training apparatus that promotes a unit/unified turn as weight is transferred at the beginning of the backswing.

Still another object of the present invention is to provide a multi-sport swing training apparatus that employs the principle of progressive resistance, and the direct link of lead hip and the implement, such that the surgical tubing utilized in the apparatus promotes width of the motion/swing and gives exact feedback to the muscles being used, thereby effectively harnessing the stored potential energy of the swing.

A further object of the present invention is to provide a swing training apparatus that creates progressive resistance during the swing, thus promoting a compact motion, which limits excessive backswing and effort.

A still further object of the present invention is to provide a swing training apparatus that allows the user to feel the desired core body tension—the differential between shoulder and hip rotation that helps produce power. As the backswing is completed, the progressive tension in the surgical tubing band is not felt in the hands. Rather, the direct attachment of the swing trainer to the handle of the club/racquet automatically, and correctly, loads the supporting muscles of the wrist, shoulder and the trunk.

Moreover, another object of the present invention is to provide a swing training apparatus that simplifies and facilitates proper weight transfer. The transition to, and the beginning of, the downswing—the bane of most athletes—is the swing trainer's strength. As the lead foot accepts the initial transfer of weight, the only conscious effort need be the turning of the lead hip. As the lead hip (the anchor of the swing trainer) turns into the forward swing, the width of the swing, and therefore the band's tension, momentarily increases and then, literally, drags the butt-end of the implement into the hitting zone. This quality, unique to the swing trainer of the present invention, results in several related events.

It is yet another object of the present invention to provide a swing training apparatus that establishes and maintains the proper sequence of the forward swing. Body and arms linked together and acting in a coordinated motion prevents the disconnect that happens with most people.

Another object of the present invention is to provide a swing training apparatus that produces lag when forward rotation of the anchor hip gently increases the already loaded tension in the band, which maximizes the stored potential energy of the swing. This translates into increased power.

Yet a further object of the present invention is to provide a swing training apparatus that requires no conscious swing thoughts or forced efforts of the hands and arms. Centrifugal force generated from the lower body and core muscles, channeled through the band, results in increased angular acceleration and the spontaneous movement of the implement through the hitting zone. This creates a multi-planar sling shot effect which maximizes power (ie. club head, racquet, or bat speed) if the mind is quiet. Any manipulation of the hands and arms results in increased tension and a disruption of the correct sequence. The swing trainer automatically provides this feedback—when the correct sequence happens you feel it, and you know. This feedback builds muscle memory.

Another object of the present invention is to provide a swing training apparatus that facilitates a natural follow-through motion after impact, guided by the trainer's ability to maintain the lower and upper body link. Again, no conscious effort is required.

Other novel features which are characteristic of the invention, as to organization and method of operation, together with further objects and advantages thereof will be better understood from the following description considered in connection with the accompanying drawings, in which preferred embodiments of the invention are illustrated by way of example. It is to be expressly understood, however, that the drawings are for illustration and description only and are not intended as a definition of the limits of the invention. The various features of novelty that characterize the invention are pointed out with particularity in the claims annexed to and forming part of this disclosure. The invention does not reside in any one of these features taken alone, but rather in the particular combination of all of its structures for the functions specified.

There has thus been broadly outlined the more important features of the invention in order that the detailed description thereof that follows may be better understood, and in order that the present contribution to the art may be better appreciated. There are, of course, additional features of the invention that will be described hereinafter and which will form additional subject matter of the claims appended hereto. Those skilled in the art will appreciate that the conception upon which this disclosure is based readily may be utilized as a basis for the designing of other structures, methods and systems for carrying out the several purposes of the present invention. It is important, therefore, that the claims be regarded as including such equivalent constructions insofar as they do not depart from the spirit and scope of the present invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DRAWING LEGEND

Figure 1:
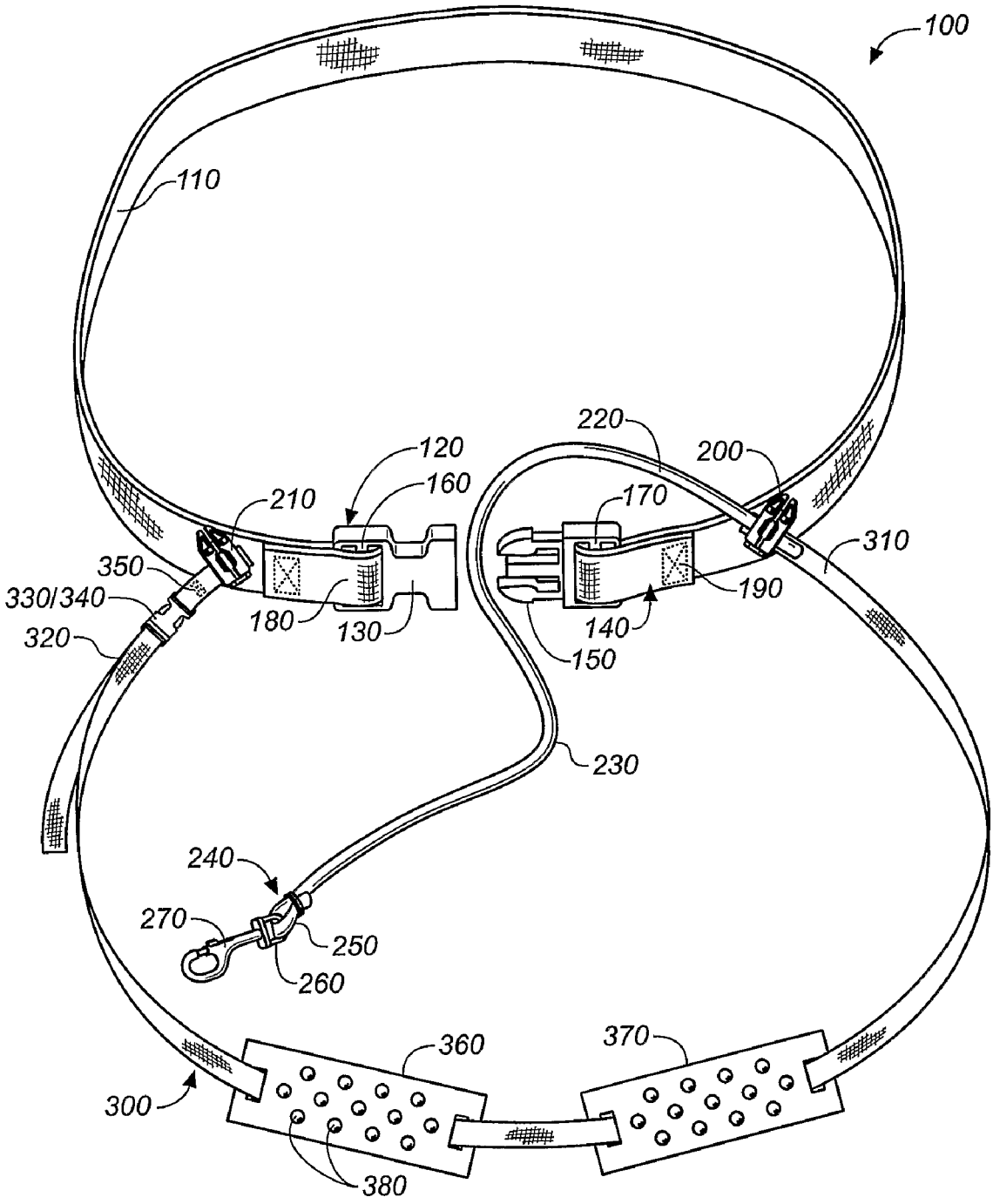
FIG. 1 is a perspective view of the first preferred embodiment of the multi-sport swing training apparatus of the present invention.

100 preferred embodiment of inventive apparatus, generally
110 waist belt portion
120 first end [of waist belt portion]
130 female buckle member
140 second end [of waist belt portion]
150 male buckle member
160 return bar [of female buckle member]
170 return bar [of male buckle member]
180 first adjustable return strap
190 second adjustable return strap
200 first clamp
210 second clamp
220 proximal end [of resilient connector]
230 resilient connector
240 distal end [of resilient connector]
250 loop [at distal end of resilient connector]
260 swivelable ring
270 clip
300 adjustable bracing strap
310 first end [of adjustable bracing strap]
320 second end [of adjustable bracing strap]
330 adjustable buckle member [at first end of adjustable bracing strap]
340 complementary buckle [at second end of adjustable bracing strap]
350 fabric strap
360 first gripping member
370 second gripping member
380 surface texture [on gripping members]
400 grip coupler
410 base portion [of grip coupler]
420 hook
430 sleeve [grip end connector]
440 grip end [of tennis racquet]
450 tennis racquet
460 grip end [of golf club]
470 golf club
700 top of golf backswing
720 wrist cock
730 left arm extension, elevation, adduction
740 initial hip turn [in golf downswing]
750 right elbow position
760 impact configuration
770 finish configuration
800 transition from [tennis] backswing to forward swing
810 finish position
900 baseball swing mechanics
1000 throwing mechanics
1100 hand and wrist harness [cuff]
1110 fabric wrap
1120 wrist portion
1130 thumb wrap portion
1140 hook and loop flap
1150 pivotal hook member
1200 user's hips
1210 user's feet
1220 user's shoulders
1230 user's spine
1240 resilient connector
1250 attachment point

BEST MODE FOR CARRYING OUT THE INVENTION

Referring to FIGS. 1 through 14E, wherein like reference numerals refer to like components in the various views, there is illustrated therein a new and improved multi-sport swing training apparatus, generally denominated 100 herein.

FIGS. 1 and 8-11 illustrate a preferred embodiment of the multi-sport swing training apparatus of the present invention, while FIGS. 2A through 7 show it used in several possible applications.

Referring now to FIGS. 1-13, the inventive apparatus is seen to comprise a waist belt portion 110, preferably a fabric strap, terminating at first end 120 in a female buckle member 130 and terminating at a second end 140 in a male buckle member 150, the latter adapted for insertable coupling with the female buckle member. The buckle members each include strap attachment means, preferably a return bar, 160, 170, respectively, which provide means to feed a first and second adjustable return strap 180, 190 back onto the waist belt portion. The fitting of the apparatus is therefore adjustable. One or both of the return straps may be secured with hook and loop fastener material to provide means of adjusting the length of the waist belt and to prevent loose fabric from flapping about during use, as is well known in the art.

Figure 8:
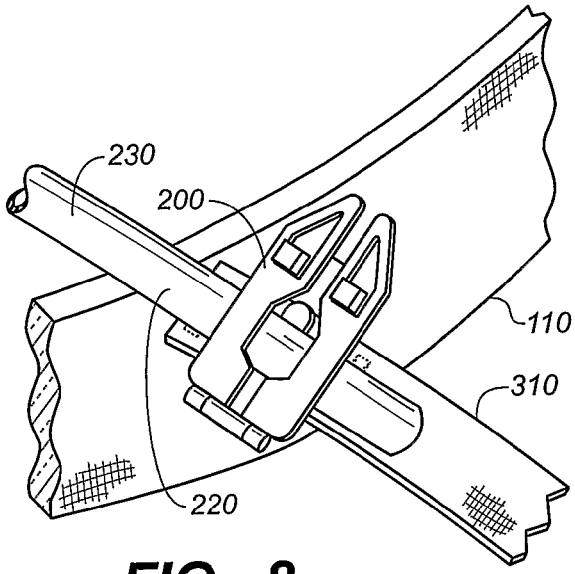
FIG. 8 shows a first end of the bracing strap (fixed to the waist belt) and also detail of the waist belt clamp employed for adjustable coupling of an end of the resilient member.
Figure 9:
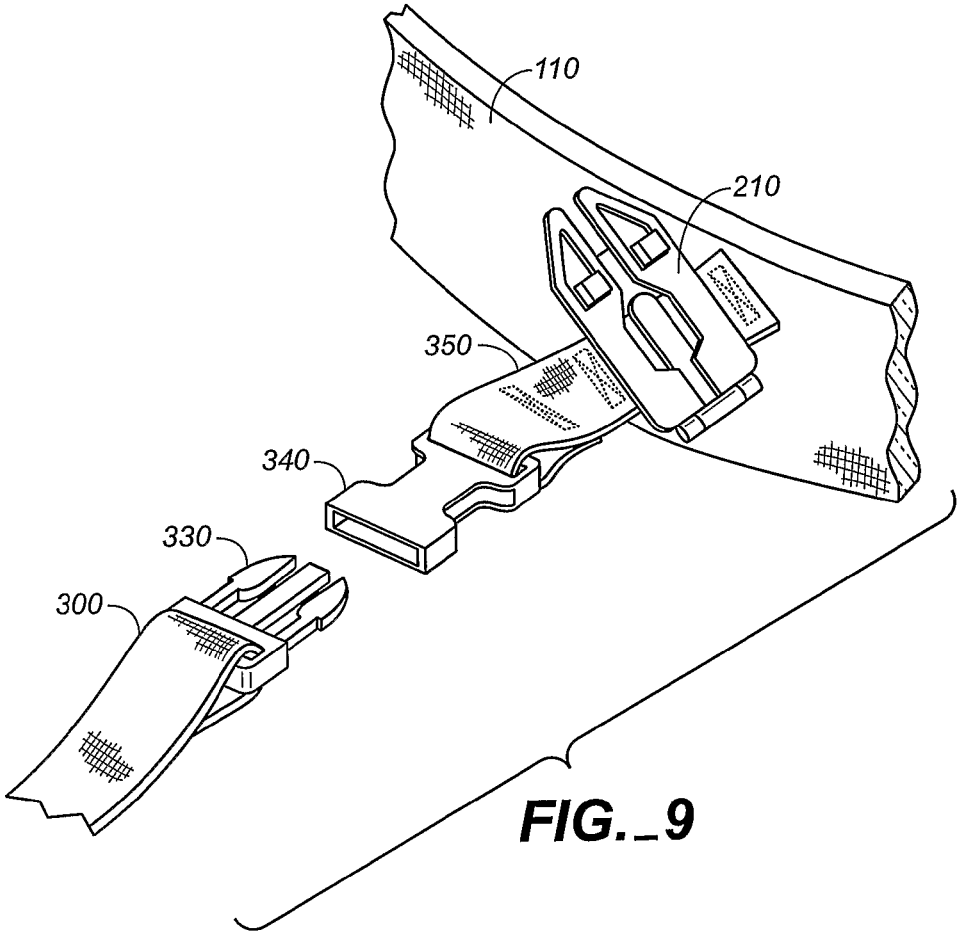
FIG. 9 shows the buckle for coupling the second end of the bracing straps to the waist belt, and the opposite side waist belt clamp for attaching the resilient member on the other side of the belt for use by a left handed person.

At least one clamp, and preferably two, e.g., first and second clamps 200, 210, respectively, are affixed to the waist belt at positions such that when the belt is worn with the male and female buckles 130/150 below the navel, the clamp on the leading side of the user is located close to the iliac crest of that side, specifically approximately immediately above and anterior the iliac crest. The particular iliac crest will depend on which side the user throws or swings from, as it is positioned on the leading, forward, or follow-through side of the motion. The clamps provide means to adjustably capture and retain a proximal end 220 of a resilient connector 230, preferably surgical tubing, or other suitable elongate resilient material. The surgical tubing may be provided with an expansion member at its end or other structure to provide a stop in the event of slippage in the clamp. FIGS. 8 and 9 provide detailed views of these structures and functions.

At its distal end 240, the resilient connector may include a loop 250, secured around a swivelable ring 260 of a clip 270 adapted for connection to a wrist cuff or a removable grip sleeve for a club, racquet, bat, or similar hitting and striking sports implement (see FIGS. 10 through 13). Numerous alternative means for attaching the clip to the resilient connector are well known in the art; thus no limitation in such means is suggested in describing the preferred embodiment herein.

Figure 7:
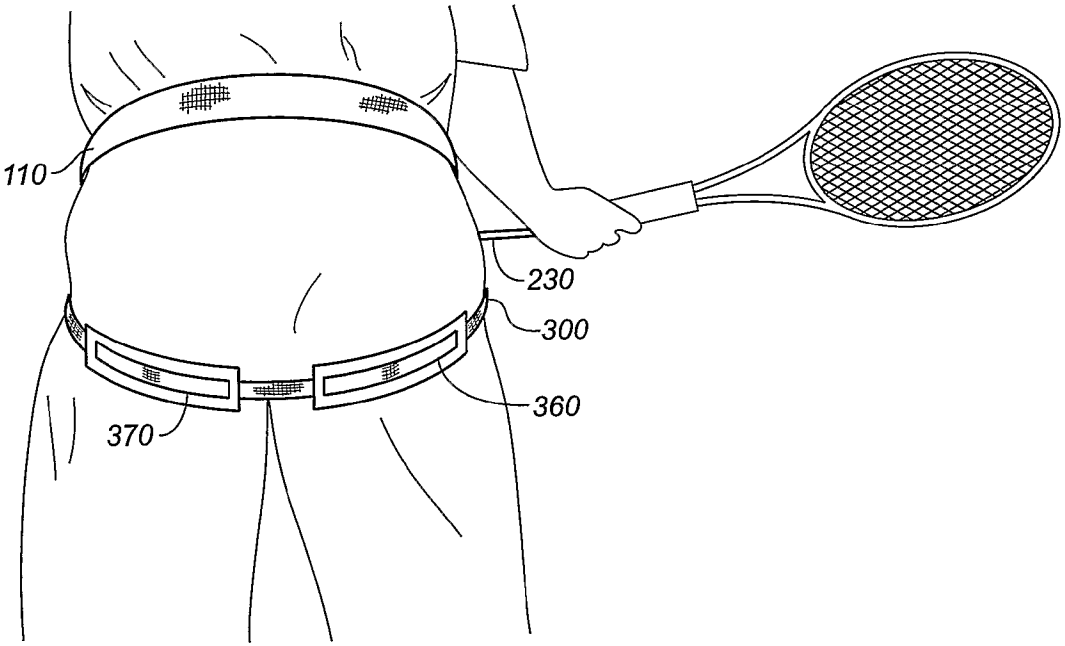
FIG. 7 is a rear view showing the bracing straps employed to secure the harness tightly on the user.
Figure 6:
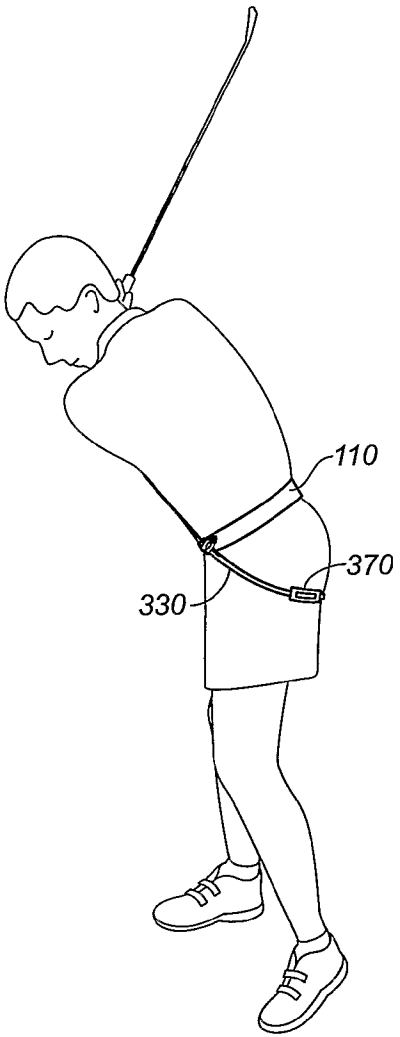
FIG. 6 is a perspective side view showing the inventive apparatus employed in teaching golf backswing mechanics.

In the first preferred embodiment, the swing training apparatus further includes an adjustable bracing strap 300 comprising a length of fabric having a first end 310 attached to the waist belt 110 proximate the first clamp 200 (which will be disposed proximate the iliac crest of the user's leading hip), and a second end 320 having an adjustable buckle member 330 adapted for coupling with a complementary buckle 340 member attached to terminal length of fabric strap 350 attached to the waist belt proximate the second clamp 210. The buckle returns a portion of fabric which may be pulled or released to adjust the overall length of the bracing strap. The bracing strap is secured generally immediately underneath at least one, and preferably both buttocks at the waist portion of the user's gluteus maximus muscles (see esp. FIGS. 6 and 7). Accordingly, it is also preferred that the bracing strap includes first and second gripping members 360, 370, disposed along the length of the bracing strap so as to be positioned immediately underneath the user's buttocks when worn. Preferably the gripping members are generally rectangular and are fabricated of a rubber material. Additionally, each of the gripping members may include surface texture 380 to enhance friction and resist displacement of the entire apparatus during use. The bracing straps are adjusted to a suitably secure but comfortable position when worn.

It will be appreciated that an adjustable bracing strap could be configured so as to attach under only one side of the user's buttocks, and though this would be disadvantageous in some respects, it is to be understood that the preferred embodiment described herein contemplates and includes such a design. In such a case, the second end could be attached at the first clamp or at another point on the waist belt.

Referring now to FIGS. 10-13, while it will be appreciated by those with skill in the art that a number of sports implement and/or hand connection means could be employed for connecting the resilient connector to the end of a handle or grip of a sports implement or to a user's hand and/or wrist, in the preferred embodiment the structure is either a grip coupler 400 or a wrist harness 1100. The grip coupler includes a substantially solid base portion 410 into which a fastener structure, such as a hook 420, may be securely molded or threadably attached. The hook 420 provides the attachment structure for clip 270 on the distal end of the resilient connector 230. The swiveling loop 260 of the clip ensures that no matter how extensive the racquet or club is manipulated or rotated, the resilient connector member will be able to tolerate the minor and minimized torsional distortions.

The coupler 400 further includes a resilient grip end connector or sleeve 430, preferably rubber or silicone, sized for removable installation on the grip end 440 of a tennis racquet 450, the grip end 460 of a golf club 470, or the grip of other ball-striking sports apparatus, such as a hockey stick, baseball bat, lacrosse stick, jai alai basket, and the like.

In use, the wearer secures the buckle portion around his or her waist so that the male/female buckle assembly 130/150 is located at the centerline of the trunk, generally immediately below the navel. The bracing strap 300 is wrapped under and around the buttocks and secured firmly, though comfortably. The proximal end of the resilient connector is then clamped at the appropriate clamp, 200 or 210, and adjusted to provide the desired amount of tension throughout the range of motion for the skill being learned. If a striking implement is involved (bat, club, racquet, and so forth), the coupler 400 is placed over the end of the handle portion so that the center of the longitudinal strap generally lines up with the longitudinal axis of the implement, and clip 270 is clipped onto hook 420.

Figure 2B:
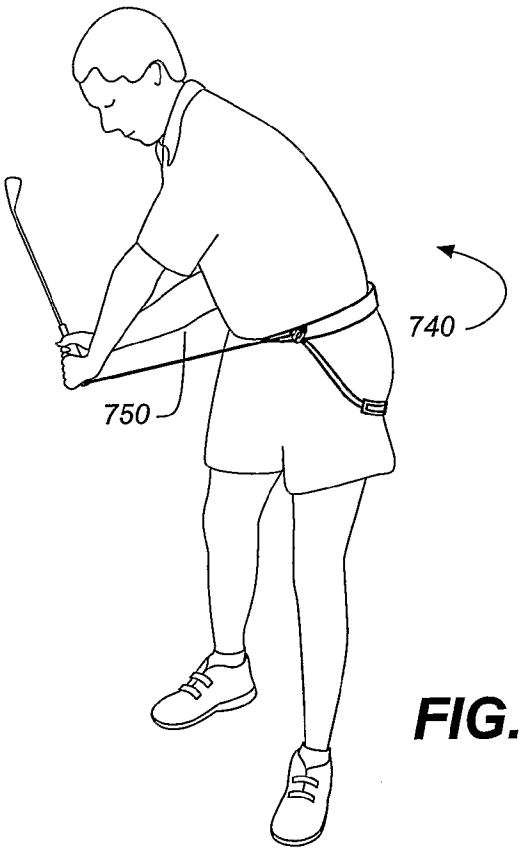
FIGS. 2A-D comprise a series of perspective views showing the inventive apparatus employed to teach the proper mechanics of a golf swing.
Figure 2A:
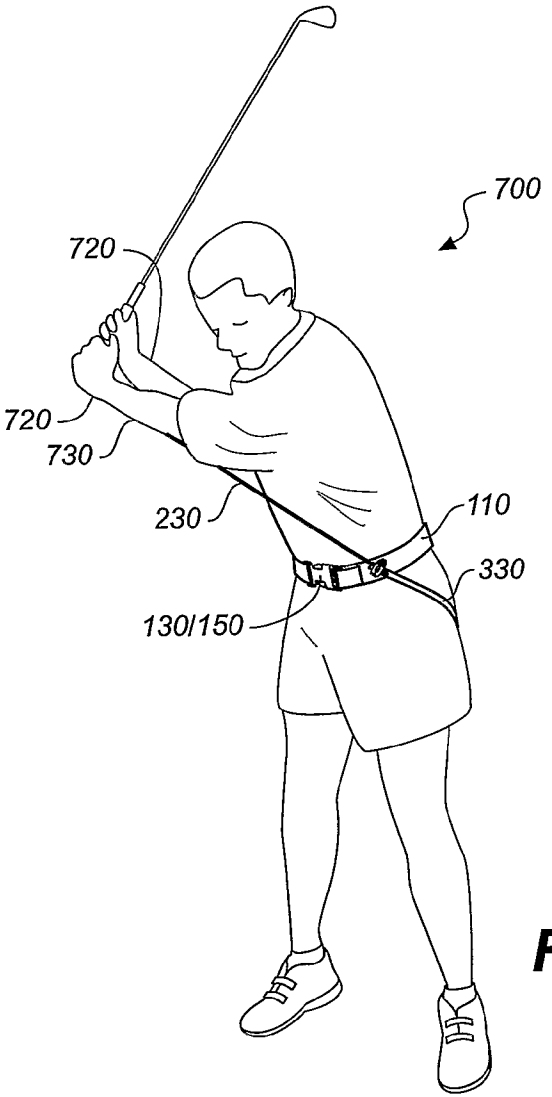

FIGS. 2A through 2D show use of the inventive apparatus for teaching the proper mechanics of the golf swing. FIG. 2A shows the golf student at the top of the backswing 700, characterized by an appropriate amount of wrist cock 720 and left arm 730 extension, elevation, adduction. This phase stretches the resilient connector 230. At this point the apparatus fosters proper arm structure in relation to the hip and shoulder configuration. Such a structure is essential to proper downswing mechanics. It should be noted that the bracing strap 300 is generally aligned with the direction of stretch of the resilient connector 230, so that kinesthetic feedback of support and tension are dramatically communicated to the user.

FIG. 2B shows the first movement into the downswing. It is at this point that the swing training device of the present invention has its most dramatic effect, as the student is easily able to sense, monitor, and sustain the tension in the tubing, much as is required in sensing, monitoring, and sustaining appropriate muscle stretch (tension) during the downswing. The apparatus therefore induces a smooth cascade of muscle contractions, a multi-planar sling shot effect, which comprise the proper sequence of movements in the downswing. For example, the initial hip turn 740 pulls and stretches the resilient connector, which in turn pulls the arms downwardly and toward impact or release. The right elbow 750 is brought close to the side of the body, and the wrist cock is naturally sustained until the appropriate release point because a rapid loss of tension reveals an inappropriate and early loss of the mechanical advantage obtained through rapid acceleration of the club at the end of the downswing sequence.

Figure 2D:
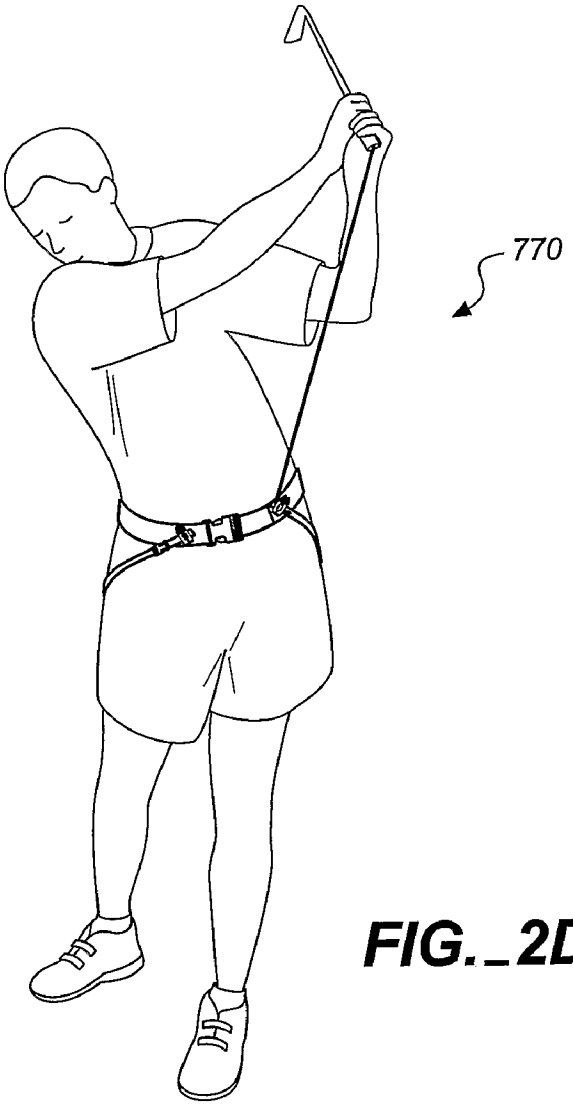
Figure 2C:
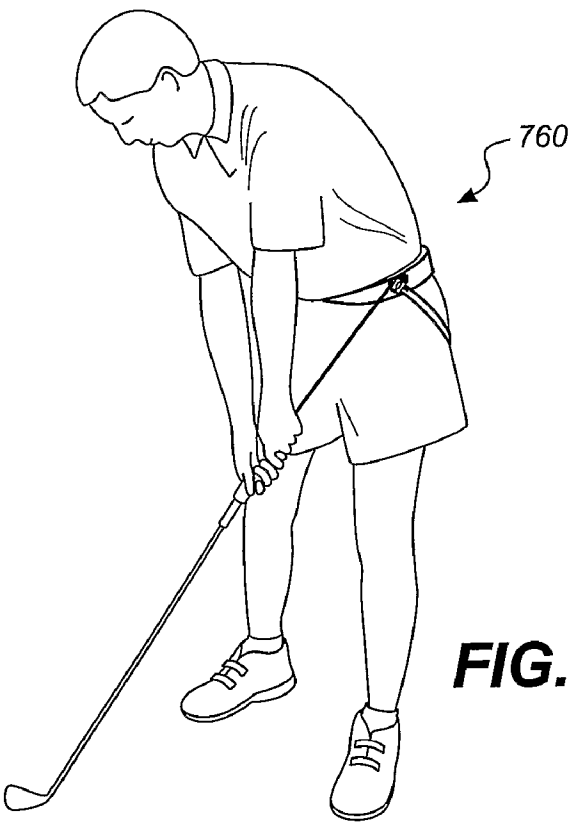

FIG. 2C shows the impact configuration 760, and FIG. 2D shows the device promoting a proper finish configuration 770. (Additional comments on the advantages of using the multi-sport swing training apparatus of the present invention are found below.)

Figure 3B:
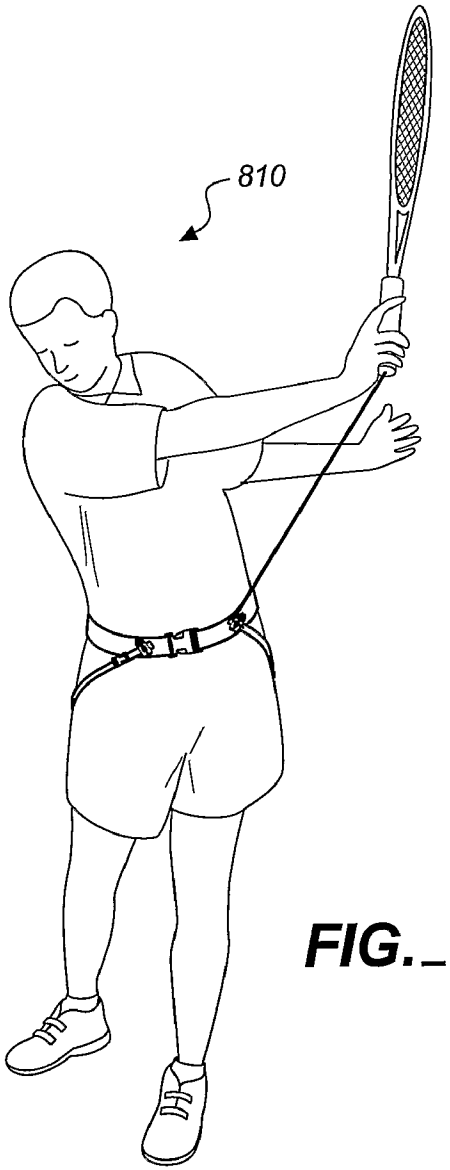
FIGS. 3A-B comprise two perspective views showing the inventive apparatus employed to teach the mechanics of a tennis swing.
Figure 3A:
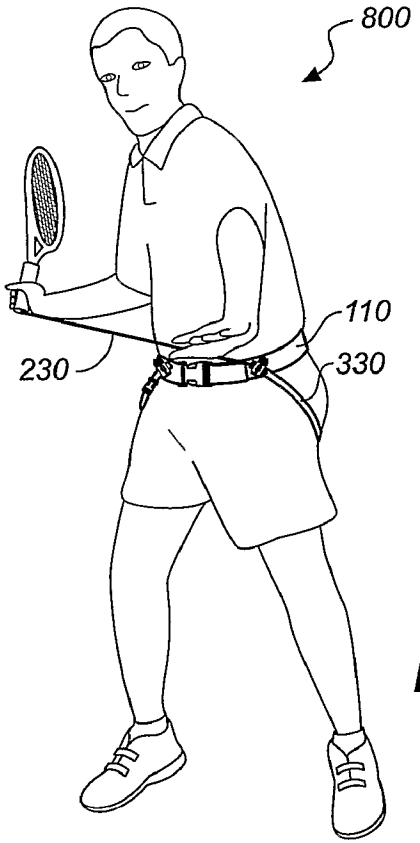

FIGS. 3A and 3B show the inventive apparatus employed to teach a tennis forehand stroke. FIG. 3A shows the forehand position as the player transitions from the backswing to the forward swing 800. FIG. 3B shows the apparatus promoting finish mechanics 810. While working on a generally horizontal plane of motion and using only one hand, the principles of operation in this application are identical to those when employed to teach golf.

Figure 5:
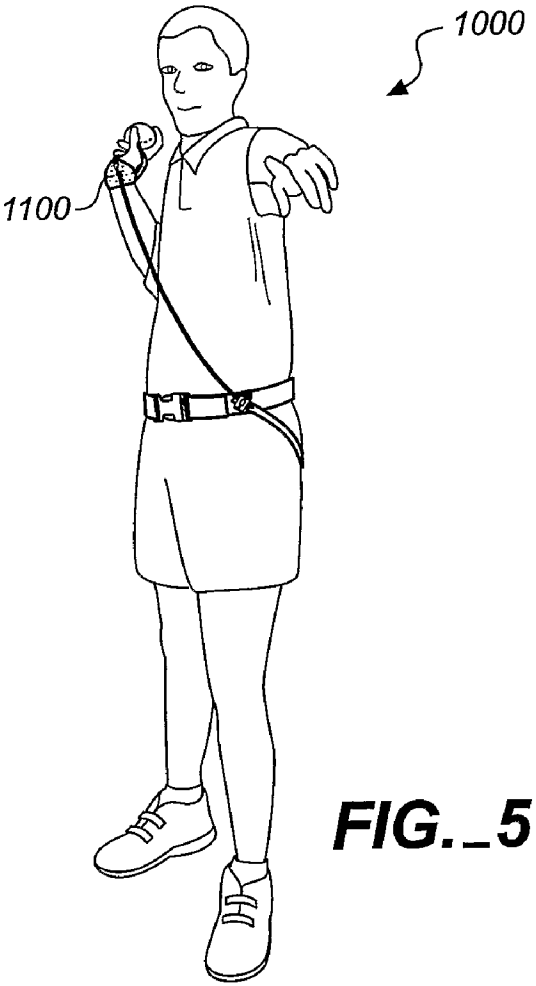
FIG. 5 is a perspective view showing the inventive apparatus employed to teach a conventional overhand throwing motion.
Figure 4:
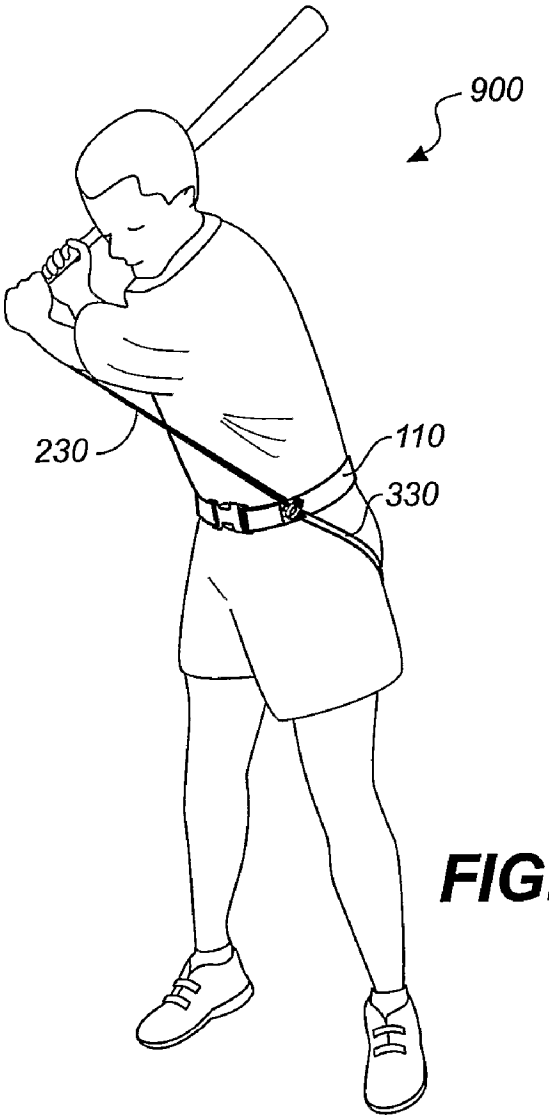
FIG. 4 is a perspective view showing the inventive swing training device employed to teach the mechanics for swinging a baseball bat.

FIG. 4 shows the inventive apparatus employed to teach baseball swing mechanics 900, while FIG. 5 shows the multi-sport swing training apparatus used to teach throwing mechanics 1000. In this latter view, the harness assembly of the inventive apparatus is attached to the student's wrist and hand, and as with use in the "hitting" sports skills described above, the apparatus promotes proper overhand throwing mechanics by helping to structure the arm in relation to the body in the preparatory phase of the motion, and then inducing the proper sequence of muscle movements in the forward throwing phase by allowing the student to feel and exploit the effect of initiating the throw with a hip turn and weight transfer. As will be appreciated, such motions include not only actual throwing motions, but closely analogous motions, such as the overhand serve and smash in tennis.

Figure 10:
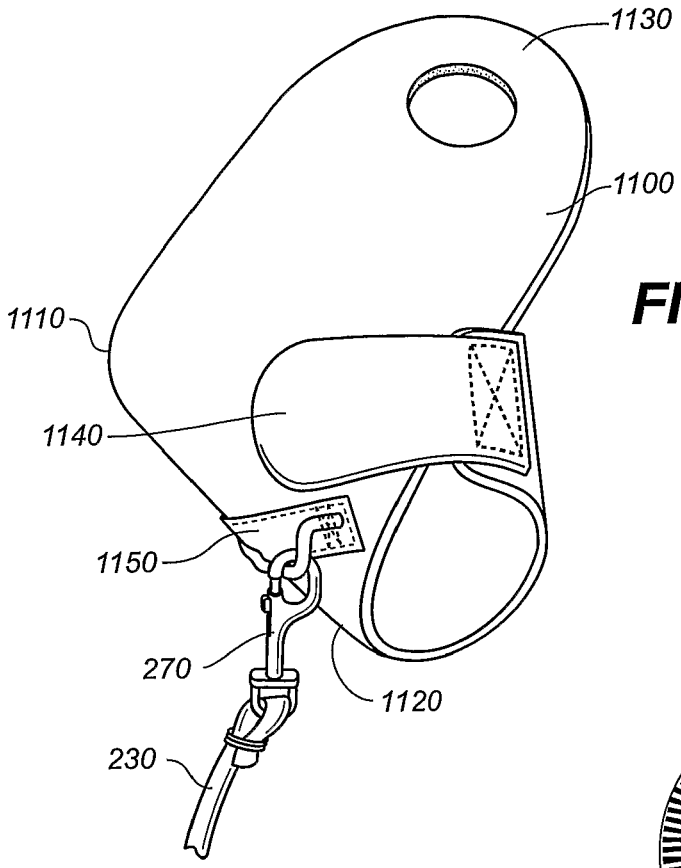
FIG. 10 shows the wrist cuff for use in teaching throwing mechanics.
Figure 11:
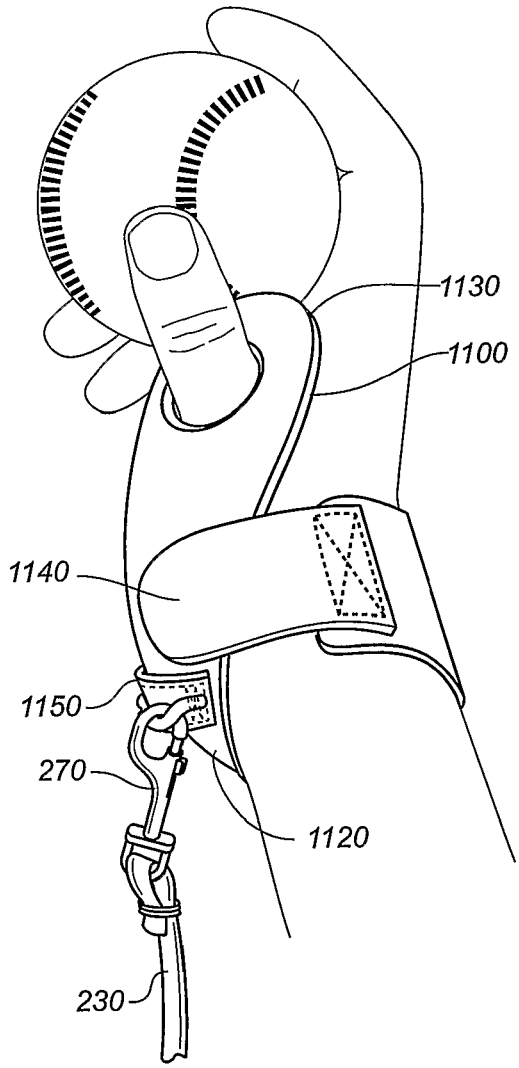
FIG. 11 shows the wrist cuff worn by a user and the resilient member attached to the wrist cuff.
Figure 12:
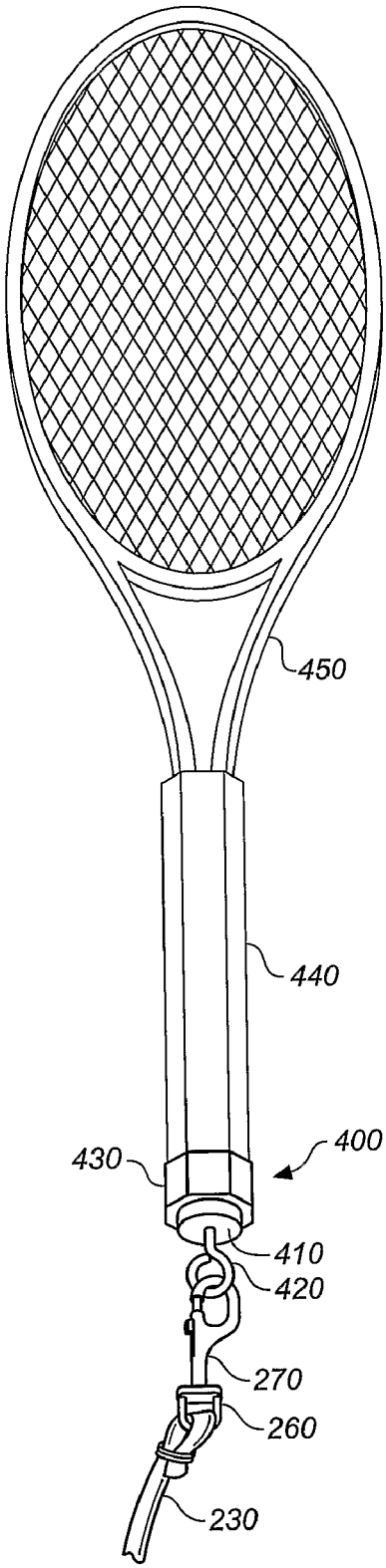
FIG. 12 shows the resilient member attached to the coupling apparatus for using the invention with a tennis racquet.
Figure 13:
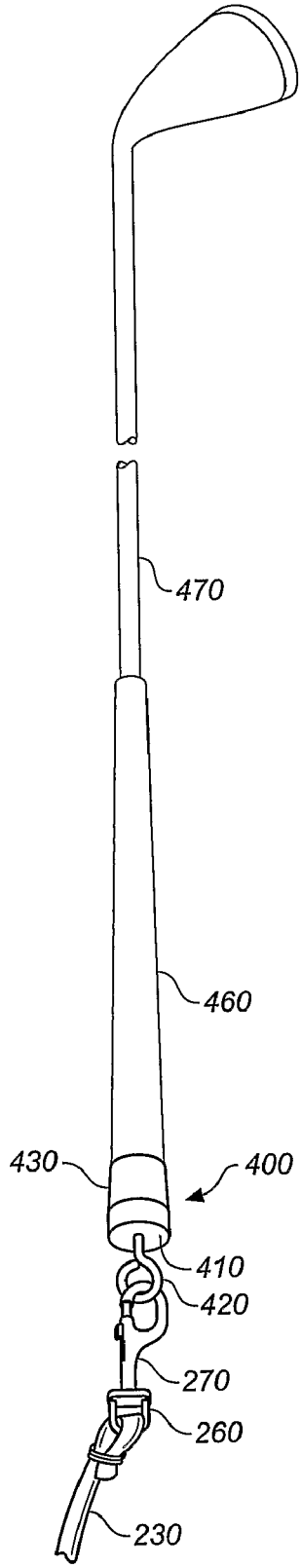
FIG. 13 shows the resilient member attached to the coupling apparatus for using the inventive apparatus with a golf club.

As is shown in FIGS. 10 and 11, the present invention can include means for connecting the surgical tubing to a hand and wrist harness 1100, or cuff. Preferably, the wrist harness comprises a generally elastic fabric wrap 1110 with a wrist portion 1120, a thumb wrap portion 1130, and a flap 1140, having fastening means, such as snaps, buttons, or complementary hook and loop fastener material which provides means for adjustably securing the cuff around the wrist and hand of the user. The cuff further includes a pivotally affixed hook member 1150 to which clip 270 at the distal end of the resilient member may be attached. When worn the hook member is positioned on the front of the wrist at the bend. An advantage of this configuration is that the pull by the resilient member on the wrist harness at the front of the wrist during the forward throwing phase induces it to hyper extend into the functional angle for throwing. Alternatively, the functional angle of 30 degrees can be molded into the wrist and hand band to preset the wrist at the top or transition phase separating the preparatory windup motion from the forward throwing motion. This arrangement reduces the ballistic throwing motion to its biomechanical essence.

The functional key to the present invention resides in its ability to induce in students the optimally coordinated movements of the upper and lower body during throwing/striking motions. It does so by using a distensible and resilient connector to link the lead (anterior) hip of the user with the end of the sports implement. The connector can be any of a number of resilient materials, including rubber surgical tubing, therapeutic or resistance training sports bands, elastic cords (such as bungee cords), and the like. Through this link the apparatus exploits several fundamental anatomic and physical principles relating to power generation. Harnessing these general principles gives the apparatus broad application in a number of related sports and sports skills.

Figure 14A:
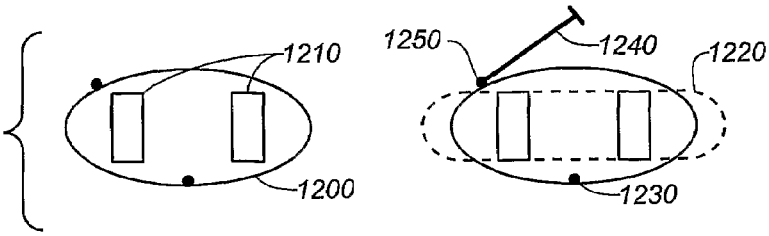
FIGS. 14A-14E are a series of schematic top views showing a sequence of relationships between a user's hips, shoulders, and feet, when using the inventive apparatus to improve swing mechanics in a right-handed tennis swing.
Figure 14B:
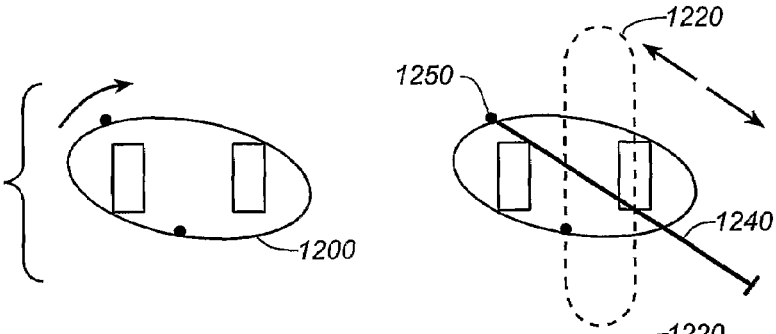

FIGS. 14A-14E show the relationship of the hips 1200 to the feet 1210 in the left hand side and the shoulders 1220, spine 1230, and resilient connector 1240 relative to the hips and feet on the right hand side. The connector 1240 is attached at the optimal attachment point 1250 proximate and substantially anterior to the leading hip. FIG. 14A shows the position of the hips, feet, shoulders, and resilient connector at address. As seen in FIG. 14B, the progressive resistance of the resilient connector 1240 increases with axial rotation of the backswing—the differential rotation of the shoulders 1230 relative to the hips 1200. The resilient connector lengthens as the swing starts and its tension is proportionate to the stored potential energy of the swing.

Figure 14C:
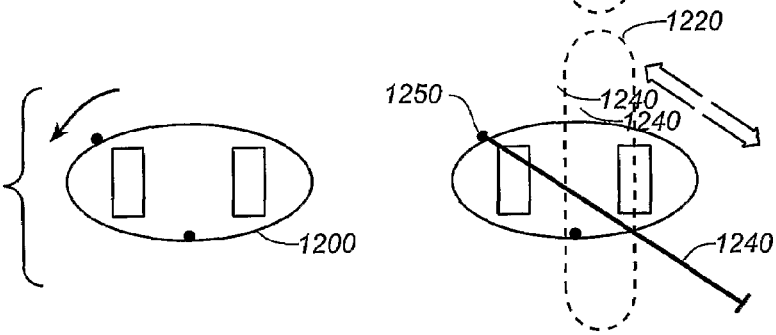
Figure 14D:
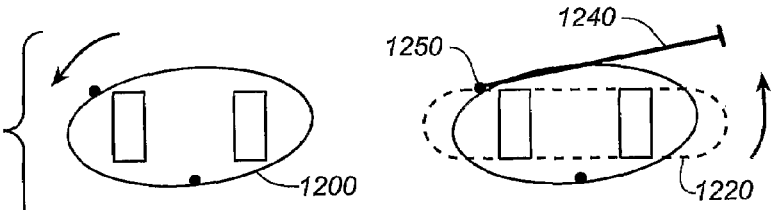
Figure 14E:
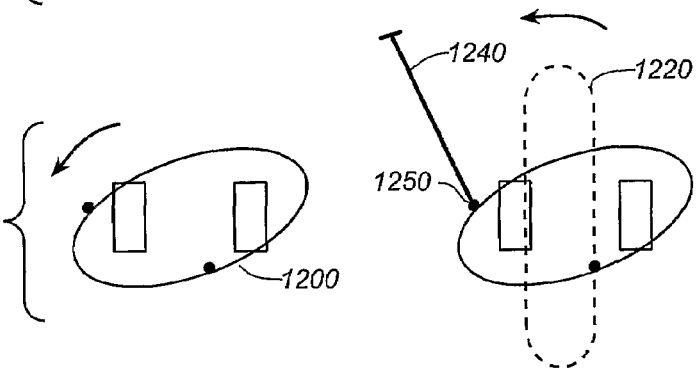

Rotation of the lead hip, the anchor point of the apparatus, is the key for the correct anatomic sequence of the forward swing. Referring now to FIG. 14C, hip rotation at the start of the downswing momentarily increases the tension in the resilient connector, loading the muscles of the arms and upper torso that support the implement by increasing the differential rotation of the shoulders and the hips. As the forward swing progresses, the apparatus produces a multi-planar sling shot effect. This translates into increased angular acceleration and produces maximum club head/racquet/bat through contact [FIG. 14D]. By maintaining tension in the resilient connector, the coordinated efforts of the lower and upper body, and the implement, are continued throughout the swing [FIG. 14E].

Thus, the inventive apparatus with its multi-planar sling shot effect produces continuous feedback about the correct sequence of the swing from all of the components of the swing, both body and implement. It produces complex muscle memory of the anatomic positions and proper sequence of a powerful swing without needing conscious thought or manipulation. It unifies and simplifies.

It will be appreciated that the present apparatus can be employed for sport-specific resistance training. Because the resilient connector offers some resistance in the backswing phase, it can be adjusted or tightened to offer more resistance. Thus, it can be particularly useful to train the fine stabilizing muscles to set and hold the arm, trunk, and should girdle in their optimal transition configuration. Additional resistance can be added by shortening the resilient member or by swapping it out for one having more resistance to deformation and stretching.

Applications of the Multi-Sport Swing Trainer—Throwing a Ball

This is a skill that most adults take for granted, yet often find hard to teach to children. With the inventive multi-sport swing training apparatus the task becomes more straightforward. A suitably sized youth model of the inventive apparatus adjusts to the waist size of children ages 4-5 through 12-13. The tension in the surgical tubing is also suitable for use by children. The adjustable hand and wrist harness encourages the wrist to be in the position of function (approximately 45 degrees of extension). The adaptable clip attaches to the hook, preferably positioned at the wrist below the palm. Learning the skill of throwing becomes an easy one, two, three process.

With the trainer on and attached to the wrist harness, the ball is taken back behind the ear of that side with external rotation, elevation and flexion of the throwing arm. The non-throwing hand is pointed in the direction of the intended throw. And a step is then taken toward the target to transfer weight and initiate opening (rotation) of the hips. The throw will happen automatically. The science is involved but the process is easy. Bringing the ball back with the wrist in extension loads the external rotators of the shoulder, and stretches the pectoralis muscle. Pointing to the target increases shoulder rotation. And stepping at the target and opening the lead hip transfers the body's momentum while increasing the tension in the resilient connector. No thoughts or concerns about what to do with the throwing hand are needed. The sequence pulls the throwing arm through the throwing zone and encourages release directly at the target. By directly linking the lead hip and the throwing wrist the trainer teaches the storing of potential energy of the wind-up and then proper release of that energy. The flexibility of the wrist support allows a natural release of the wrist with the throw. The results are often dramatic, and the trainer builds muscle memory.

Hitting a Baseball—Swinging a Bat

The complement of throwing a ball is hitting it. The inventive multi-sport swing training apparatus is uniquely suited to help with both. The batter need only apply and adjust the swing trainer's belt with the anchor of the resilient connector attached over the lead hip—the left hip for right-handed batters. The adaptable grip end connector forming the other end of the device allows one to secure the trainer directly to the end of the bat. Developing a coordinated and powerful swing motion with the swing trainer is then quite easy. The batter plants his/her back foot with most of the body weight on the instep—which loads the quadriceps and leg adductors—while simultaneously taking the bat back with the hands and arms and turning the shoulders. This coiling motion of the upper body increases tension in the swing trainer's resilient connector and automatically induces several anatomical advantages.

First, the differential turn of the shoulders and the hips places the lead shoulder under the chin, just below the line of sight for the eyes. Second, the lead arm tends to straighten as the bat is taken back against the tension of the band, effectively maximizing the width of the swing—the cap/butt end of the bat is pushed away from the body by the lead arm. Third, to complement the effort of the lead arm, the trailing arm (the upper hand of the batting grip) assumes three important features: the arm (humerus) externally rotates in the shoulder joint, tending to tuck the elbow towards, but not against, the side; the elbow bends to approximately 90 degrees; and the wrist is extended (laid back) to an angle of between 45 and 60 degrees. These positions are necessary to unify the efforts of body and arms and form a forceful lever with which to apply power. The tension in the band is translated into maximal potential energy within the body and there is no extra tension within the hands (grip).

The forward swing turns this stored energy into bat speed. A short stride with the lead foot and a forceful pushing off with the rear instep start the weight transfer. The fast rotation of the hips (opening the forward hip) while keeping the bat back increases the resilient connector tension and drags the end of the bat into the hitting zone. The resilient connector tension reinforces the arm positions (external rotation of the posterior shoulder and extension of the wrist), helping to create lag, and maintain the relationship of the lower body and arms. This feature allows the centrifugal force generated by the controlled, sequential movement of the lower body to be released at impact by the relaxed hands, thus whipping the bat through the hitting zone. The feel of this relationship is unmistakable and, with the swing trainer, quickly learned.

Tennis—Groundstrokes and Movement

The sport of tennis adds several levels of complexity to the principles of a basic swing. First, the strokes are made on the move and not from a static stance. Second, the swing plane is variable, and not always horizontal (the height of the ball at impact varies). Third, strokes are hit from both sides of the body—forehand and backhand. Though these features of tennis add a degree of difficulty, they do not change the fundamental requirements of a correct, powerful swing: setting a stable and balanced platform, using axial rotation of the spine to store energy in the backswing, and unifying the effort of the lower body and racquet with a sequential forward swing that delivers the potential energy to the ball through relaxed arms. An advantage of the inventive multi-sport swing training apparatus is that it generates feedback. It does not directly teach footwork, but if a player's adjustments to the oncoming ball are correct, he/she knows it immediately. A sequenced effort is discerned in the quality of contact and, conversely, if a disruption in the proper body, arm, wrist sequence occurs, the inventive apparatus amplifies the feedback to the player. These features allow players of all levels to learn from the inventive multi-sport swing trainer.

The forehand stroke is made with the player's dominant arm gripping the racquet while in the trailing position. Because of the freedom of movement of the shoulder, arm, and wrist, player's wrestle with three questions: Where to put the arm in relation to the body; how far back to take the racquet back in the swing; and what to do with the wrist throughout the stroke.

The efforts of most newcomers conflict with the correct answers. Taking the racquet back early immediately disconnects the arm from the body. The racquet is taken back too far in an attempt to generate power. And the wrist is manipulated through the contact zone in an attempt to impart spin and power to the ball. The swing trainer dissuades misguided attempts, while it helps answer these questions simultaneously.

The direct connection of the lead hip to the racquet via the trainer's resilient connector promotes a unit turn of the upper body and shoulders. "Taking the racquet back" involves mostly shoulder turn and external rotation of the arm within the shoulder, not direct movement of the arm away from the body. The elbow naturally bends and moves inward and forward in relation to the body, not away from and behind. This movement of the arm stabilizes the biceps and pectoralis muscles, which maintains the body and arm connection. The wrist automatically assumes a position of extension, called the position of function or strength, as the progressive resistance of the resilient connector increases. The increasing stretch prevents excessive backswing and loads the muscles in unison. In essence the multi-sport swing training apparatus promotes a compact, mechanically correct (i.e., efficient) swing.

The forward swing of the forehand is an unwinding and transfer of stored power into racquet speed, which is used to impart spin and pace to the ball. The inventive multi-sport swing training apparatus works for both an open forehand and the traditional forward-step version because the swing dynamics are the same: explosive weight transfer from the rear leg forward, with rapid hip rotation produces lag with the racquet, which is then dragged through the hitting zone by the unified motion of the upper torso and arm. The swing trainer establishes the lower and upper body connection, and by keeping tension in the resilient connector during the swing it maintains it.

Several features of the tennis forehand bear comment. The transfer of weight from the rear leg is forward, around (due to rotation of the hips), and up (secondary to the unloading of the quadriceps muscle). Knee bend during the backswing not only helps player's adjust to varying ball heights but also increases stored energy and is a key component of generating topspin as the racquet moves from low to high, brushing up the back of the ball during the forward swing. The swing trainer keeps the wrist, and therefore the racquet, stable through the entire hitting zone. This is essential for consistent and powerful strokes. It correctly teaches that topspin is not a function of wrist movement or manipulation during the swing. The resistance of the swing trainer is maintained during the follow-through and promotes the natural internal rotation of the arm at the shoulder seen in accomplished players. Again, the anatomic details are complex, but the player need not think about them. The swing trainer produces the correct forward sequence with only one objective: namely, rotating the lead hip.

The backhand stroke is either one or two-handed, depending on player preference, and involves moving the dominant arm in front of and across the chest. The grip in a one-handed topspin backhand brings the palm on top of the racquet and the thumb behind or under. The angle of the wrist is essentially the same as that of the forehand stroke, and the wrist is extended into a position of strength. By straightening the elbow the width of the stroke is increased, and by externally rotating the arm at the shoulder one completes the link of body and arm to make a powerful unit with which to rotate and hit the ball. The trailing arm helps bring the racquet back and slightly out from the body as the shoulders turn. In a two-handed backhand the trailing hand is above the lead hand on the grip and assumes the same features seen in the baseball swing—wrist extended to the position of function, elbow comfortably bent with the arm set in external rotation at the shoulder. The lead hand can, but need not, keep the same position as in the one-hand stroke. The swing trainer encourages these positions during the backswing due to the stretching of the muscles by the progressive resistance of the resilient connector. The belt of the trainer is shifted around for the backhand so the connector is anchored over the lead hip. The forward swing, like the other types of swings detailed before, is an sequential uncoiling of the body. Starting with weight transfer of the balanced lower body and rotation of the lead hip, the swing trainer's tension pulls the end of the racquet toward the hitting zone; the head of the racquet catches up with the handle in the hitting area due to axial rotation (rotation around the spine) and the resultant angular acceleration. This force, generated by the body's sequence, flows through the arms and is not initiated by them. The swing trainer translates this force into feeling through tension in the resilient connector and its ability to maintain the connection of lower body with arm movement throughout the swing. This produces a stable, flat (perpendicular) racquet head as it brushes up the back of the ball, transferring the swing's energy into pace and control.

The Golf Swing

Golf's differences add still more complexity to the fundamental striking motion. First, the ball is small, and so to is the head of the club striking it, while the length of the lever arm (the club) is substantial. Next, the motion is discrete and non-continuous. The ball is stationary, so rather than being a rapid (almost unconscious) response to the motion of the ball, the golf swing is a deliberately created effort which begins from a virtual standstill. Thus, the player is afforded ample time to think about his/her next swing and shot.

Next, the ball is on or near the ground, which is occasionally hard and resistant to club penetration. Sometimes this comes into play psychologically as many people appear to be afraid of touching or damaging the ground or of injuring themselves. Also, the ball's position makes the plane of the golf swing tilted, or more vertical than a baseball bat swing. The plane is governed in part by the angle of our spine and the shaft of the club, rather than horizontal. A certain amount of trust and skill is required to know that the small distal end of the club will even strike the little ball, let alone launch it in the desired direction. These basic features lead to a lack of trust and fuel the conscious attempts of our brain to manipulate the swing to try and control the outcome of shots. That's where golf advice comes into play.

Few things that humans do have faced the analytical scrutiny applied to the golf swing—books, magazines, countless articles, devices, and television shows are all devoted to helping people master this motion. Many of these methods have tremendous merit, but frequently the message is lost in translation as the player attempts to apply it to his/her own swing. The complexity of the swing limits the effectiveness of this detail-based teaching. A new thought replaces a "faulty" old thought, joining a myriad of recent thoughts, as a player tries to discover what works today. This clouding of the mind produces uncertainty, frustration, and tension in most people and, at best, inconsistent results. Yet, because of the occasional, seemingly random excellent shot, players associate their sporadic success with the content of their pre-shot swing thoughts, and thus they superstitiously persist in planning their shots during play with conscious swing thoughts, guarding them carefully and feverishly trying to remember their peculiar tone and feel, as though they possessed talismanic power.

The inventive multi-sport swing training apparatus is different. Its primary strength is that it frees the mind. It allows the player to let go of the minutia of the golf swing and the mental baggage it invites before starting the motion. It teaches by producing feeling—the feeling of a whole swing and its correct sequence, not just of one small portion of it like so many other tips and devices. The effect of this feeling is profound, and with the swing trainer it is reproducible, which creates active muscle memory.

The core principles of the golf swing are the same as those previously described—weight transfer within a balanced base leads to a unit turn of the upper body and club; this axial rotation leads to differential rotation of the shoulders and stores potential energy as the backswing is completed; the forward swing is a sequence of weight transfer, active rotation of the hips, which produces lag, and the passive transfer of force through the arms producing club head speed through contact with the ball.

Practice with the swing trainer allows the number of swing thoughts to be kept to a minimum. Details of grip, stance and alignment, and decisions about the shot, including visualization, are made beforehand, during a player's pre-shot routine, and then trusted. The player then lets the swing happen. Feedback with the swing trainer is immediate. As the backswing is started the trainer's tension is felt, establishing the connection of the lower body and the arms. A one-piece unit turn starts with the lead arm hanging down comfortably, neither pushing the grip out, nor drawing it back in. At first, it is helpful to stop the backswing part-way back, with the club horizontal to the ground, to reinforce the feeling of this position. An on-plane swing will pass through it going back and during the downswing. The shaft of the club points straight back so the grip end of the club where the swing trainer is attached points down the target line. The shaft can angle slightly out (club head away), but should not be angled in (club head behind). The lead arm is straight and the back of the wrist is flat, or nearly so, depending on the grip. The club face is vertical in relation to the ground, or slightly closed, generally between an 11 and 12 o'clock position. The trailing arm shows several familiar anatomic features: the arm is set in the shoulder socket by external rotation, leading the elbow to be near the side and bent to approximately 90 degrees, with the wrist in extension, at about 60 degrees, in the position of function.

The goal of the remainder of the backswing is to increase axial rotation around the spine and increase stored potential energy. This translates into rotating the shoulders in relation to the lower body, and pushing the butt-end of the club away and up. No conscious thoughts of the hands or wrists are needed. And no extra grip pressure or tension is generated. Rather, the increasing tension of the swing trainer's resilient connector is felt through the series of muscles that have lead to this position. It should be noted that the swing trainer neither forces nor guarantees a correct swing. Many trainers including vests and jackets and binding devices force a "correct" swing by imposing positions and severely restricting motion. The inventive multi-sport swing training apparatus does not make choices for the player; instead it generates feedback and feel. A person can be off plane or out of sequence, but he will know it because he will feel it. The swing trainer works because the progressive resistance felt by linking the lead hip and the end of the implement generates considerable power with optimal muscular efficiency. With practice, muscles will assume correct positions, if a player so allows. This type of learning, involving player-directed adjustments based on correct feel, produces a deeper trust.

The downswing is all about sequence. Most golfers, consumed with swing thoughts and fears of mishits, rarely feel the proper sequence. Their downswings are a series of compensations made in an attempt to redirect and regain control of the considerable force they intend to unleash on the ball. By contrast, with the inventive multi-sport swing training apparatus, only one thought is necessary: the feeling of rotating, or opening up, the lead hip. The swing trainer then reinforces the correct sequence, which mirrors the sequence as set out above in the discussions of throwing, batting, and hitting a tennis ball. The weight is transferred to the lead foot, the stretch of the resilient connector increases as resistance sets the muscles of the upper body and arms which reinforces the angles already produced (increases lag), which allows the rotation of the hips to drag the butt-end of the club into the hitting zone. This preserves the stored energy of the swing which is then translated by centrifugal force into angular acceleration (club head speed), causing the club head to catch up to the hands/arms/lead side of the body at the moment of impact. The wrists and hands are "released" naturally by the process, or sequence, and not through any willful effort. Contact is merely a point along the continuum of the swing. The follow through is along the same plane and the trainer's continued input (tension) maintains the lower and upper body connection, and angles, as the swing finishes.

The modern professional golf swing includes several features, including: (1) stability, i.e., throughout the backswing the feet remain generally flat on the ground with little or no lead leg heel lift; (2) modest hip rotation, i.e., a quiet lower body; (3) increased differential rotation of the shoulders relative to the hips; (4) increased width of the swing; and (5)

power—translating stored potential energy of the backswing into club head speed via a sequential, on-plane downswing keyed by rapid hip rotation.

Even though the inventive apparatus is largely directed to full strokes and swings, any of the swing motions in golf that employ both upper and lower body motion can take advantage of the inventive apparatus, including chipping, pitching, and partial strokes of any kind that involve hip motion to actuate the downswing.

These traits, which are the focus of the inventive multi-sport swing training apparatus, transcend golf and allow multiple applications. The trainer's unique ability to connect and meld the efforts of the lower and upper body, and the implement, results in profound input about the proper sequence of applying power. With the physical actions of the body unified, the mind remains quiet and free of tension, and the user is relieved of the perceived need to consciously control the stroke or swing. This represents a fundamentally new way to teach complex sports skills, termed biomechanical integration. In this state, mind and body learn as one, and act as one, and focused effort happens naturally. Accordingly, the multi-sport swing training apparatus is a physical training device that ultimately enhances mental awareness.

As will be noted, the skill set comprising efficient muscular action in each of the above-described sports is effectively transferable to each of the other sports. Accordingly, distilled to its essence, what is disclosed herein as a method of teaching the optimal biomechanicl integration employed in hitting and throwing skills that includes the following steps: (a) providing a multi-sport training apparatus for teaching and improving hitting and throwing skills, the apparatus including an adjustable waist belt having a first end and a second end and having connection means disposed on the first and second ends for connecting the first and second ends; a resilient connector having a distal end and a proximal end; at least one clamp affixed to the waist belt; attachment means disposed on the distal end of the resilient connector; and sports implement/hand connection means for connection to the attachment means; (b) providing a sports implement; (c) placing the waist belt around the waist of the user and positioning it such that the clamp is located proximate the iliac crest of the user's leading hip; (d) using the clamp to adjustably capture and retain the proximal end of the resilient connector; (e) having the student make the preparatory windup or backswing motion; (f) having the student initiate the forward phase of motion by transferring weight in the direction of the target and simultaneously turning the hips toward the target.

The foregoing disclosure is sufficient to enable one having skill in the art to practice the invention without undue experimentation, and provides the best mode of practicing the invention presently contemplated by the inventor. While there is provided herein a full and complete disclosure of the preferred embodiments of this invention, it is not intended to limit the invention to the exact construction, dimensional relationships, and operation shown and described. Various modifications, alternative constructions, changes and equivalents will readily occur to those skilled in the art and may be employed, as suitable, without departing from the true spirit and scope of the invention. Such changes might involve alternative materials, components, structural arrangements, sizes, shapes, forms, functions, operational features or the like.

Accordingly, the proper scope of the present invention should be determined only by the broadest interpretation of the appended claims so as to encompass all such modifications as well as all relationships equivalent to those illustrated in the drawings and described in the specification.

What is claimed as invention is:

1. A multi-sport training apparatus for teaching and improving hitting and throwing skills, said apparatus comprising:

an adjustable waist belt having a first end and a second end and having belt couplers disposed on said first and second ends for connecting said first and second ends;

a resilient connector having a distal end and a proximal end;

at least one clamp affixed to said waist belt such that when said waist belt is worn said clamp is located proximate the iliac crest of the user's leading hip, said at least one clamp for adjustably capturing and retaining said proximal end of said resilient connector;

a clip having a swivelable ring disposed on said distal end of said resilient connector; and a grip coupler having a resilient sleeve for removable installation over at least an end portion of a grip or handle of a sports implement and a base portion with a fastener structure for connection to said clip disposed at said distal end of said resilient connector;

whereby said apparatus promotes proper hitting and throwing mechanics of a user by structuring the user's dominant arm in relation to the user's body in the preparatory phase of the throwing and/or striking motion, and then induces a proper sequence of muscle movements in the forward throwing or striking phase by inducing the user to feel and use the effect of initiating the throw or hit with a hip turn and weight transfer.

2. The apparatus of claim 1, wherein said belt couplers comprise a first buckle member attached to said first end, and a second buckle member attached to said second end and being complementary to said first buckle member.

3. The apparatus of claim 1, wherein said resilient connector is selected from the group consisting of surgical tubing, sports band, and elastic cord.

4. The apparatus of claim 1, wherein said clip includes a swivelable ring adapted for connection to said grip coupler.

5. The apparatus of claim 1, further including at least one adjustable bracing strap having first and second ends, said first end attached proximate said at least one clamp, and adjustment means for lengthening or shortening the distance between said first and second ends.

6. The apparatus of claim 5, wherein said second end of said adjustable bracing strap is attached to said waist belt proximate said second clamp.

7. The apparatus of claim 5, wherein said adjustable bracing strap includes at least one gripping member disposed immediately underneath the user's buttocks for resisting lateral movement of said waist belt during use.

8. The apparatus of claim 1, wherein said fastener structure is a hook.

9. A method of teaching a user the optimal biomechanical sequence of muscle movements in those hitting and throwing skills involving a forward movement initiated by a hip turn and a weight shift, comprising the steps of:

(a) providing a multi-sport training apparatus for teaching and improving hitting and throwing skills, the apparatus including an adjustable waist belt having a first end and a second end and having belt couplers disposed on the first and second ends for connecting the first and second ends; a resilient connector having a distal end and a proximal end; at least one clamp affixed to the waist belt; a clip having swivelable ring disposed on the distal end of the resilient connector; and a grip coupler for connection to the clip, said grip coupler having a resilient sleeve for removable connection to an end portion of the grip of a sports implement;

(b) providing a sports implement and placing the resilient sleeve of the grip coupler over at least an end portion of the grip or handle of the sports implement;

(c) placing the waist belt around the waist of the user and positioning it such that the clamp is located proximate the iliac crest of the user's leading hip;

(d) using the clamp to adjustably capture and retain the proximal end of the resilient connector;

(e) having the user make the preparatory windup or backswing motion; and (f) having the user initiate the forward phase of motion by transferring weight in the direction of the target and simultaneously turning the hips toward the target, thereby inducing the proper sequence of muscle movements in the forward throwing or striking phase by helping the user to feel and use the effect of initiating the throw or hit with a combined hip turn and weight transfer.

10. The method of claim 9, wherein the sports implement is selected from the group consisting of golf club, tennis racquet, baseball bat, hockey stick, lacrosse stick, jai alai basket, and ball.

11. A sports training apparatus for teaching the optimal sequence of muscle movements in those hitting and throwing motions that involve a forward motion initiated by a hip turn, said apparatus comprising:

an adjustable waist belt having a first end and a second end and having couplers disposed on each of said first and second ends for connecting said first and second ends;

a resilient connector having a distal end and a proximal end;

at least one clamp affixed to said waist belt for adjustably capturing and retaining said proximal end of said resilient connector, such that when said waist belt is worn by a user, said at least one clamp is located proximate the iliac crest of the user's leading hip;

a clip having a swivelable ring disposed on said distal end of said resilient connector; and a grip coupler having a resilient sleeve for removable attachment to at least an end portion of the grip or handle of a sports implement, such as a racquet or a club, or, alternatively, to a user's upper extremity and to said clip;

wherein in use said apparatus promotes proper hitting and throwing mechanics by structuring a user's dominant arm in relation to his or her body in a preparatory phase of the throwing and/or striking motion, and then promotes a proper sequence of muscle movements in a forward throwing or striking phase by inducing the user to feel and use the effect of initiating the throw or hit with a combined hip turn and weight transfer.

12. The apparatus of claim 11, wherein when in use, the user holds the sports implement in at least his/her dominant hand, and when making a windup or backswing motion said resilient connector extends from the grip of the sports implement to said at least one clamp located proximate the iliac crest of the user's leading hip and is thereby stretched laterally across the midline of the user's body from the leading hip of the user to the implement, such that when the forward phase of the throwing and/or striking motion is initiated with a hip turn and weight transfer, a mild stretch of the resilient connector induces the optimal sequence of muscle movements commencing with the legs and hips and continuing sequentially through the trunk, torso, arms, and hands.

* * * * *